United States Patent [19]

Link et al.

[11] 4,241,762

[45] Dec. 30, 1980

[54] COMPOSITE UNDERGROUND FLUID CONDUIT OF CONCRETE AND STEEL SECTIONS

[75] Inventors: Heinz Link; Heribert Schupp, both of Oberhausen; Heinz Lendla, Duisburg, all of Fed. Rep. of Germany

[73] Assignee: Gutehoffnungshutte Sterkrade Aktiengesellschaft, Oberhausen, Fed. Rep. of Germany

[21] Appl. No.: 15,628

[22] Filed: Feb. 27, 1979

[30] Foreign Application Priority Data

Feb. 27, 1978 [DE] Fed. Rep. of Germany ..... 2808387

[51] Int. Cl.[3] ..... F16L 1/00

[52] U.S. Cl. ..... 138/105; 138/120; 138/155; 138/175; 138/143; 405/133

[58] Field of Search ..... 138/120, 155, 143, 175, 138/105; 405/133, 134, 135, 152, 153, 143; 166/242; 285/55, 230

[56] References Cited

U.S. PATENT DOCUMENTS

| | | | |
|---|---|---|---|
| 2,042,132 | 5/1936 | Treskow | 138/175 X |
| 3,474,834 | 10/1969 | Carey | 138/155 X |
| 3,742,985 | 7/1973 | Rubenstein | 138/155 X |
| 3,963,056 | 6/1976 | Shibuya et al. | 138/175 |

FOREIGN PATENT DOCUMENTS

| | | | |
|---|---|---|---|
| 1129436 | 5/1962 | Fed. Rep. of Germany | 405/133 |
| 953284 | 3/1964 | United Kingdom | 405/133 |

*Primary Examiner*—James E. Bryant, III

*Attorney, Agent, or Firm*—Toren, McGeady and Stanger

[57] ABSTRACT

A composite underground shaft lining assembly particularly suitable for use as a leak proof water conduit is formed with a plurality of annular concrete sections joined together by interposed layers of flexible joint material forming a composite concrete cylinder, with a composite steel cylinder formed of annular steel sections being arranged about the outer cylindrical surface of the composite concrete cylinder. The annular steel sections of the composite steel cylinder are joined together by spring rings located adjacent the flexible joints formed between the annular concrete sections.

11 Claims, 7 Drawing Figures

COMPOSITE UNDERGROUND FLUID CONDUIT OF CONCRETE AND STEEL SECTIONS

BACKGROUND OF THE INVENTION

The present invention relates generally to underground fluid conduits and more particularly to a composite shaft lining which is flexible and generally leak proof and which is formed of a concrete cylinder comprising individual concrete rings separated by joints with at least one supporting steel cylinder being connected thereto.

It has heretofore been known to utilize concrete cylinders and supporting steel cylinders connected together for lining shafts in water-bearing, loose-ground strata. Such linings generally act as composite linings for an underground shaft or formation.

As a rule, frictional forces will insure that a bond is established between the concrete cylinder and the outer steel cylinder which is arranged in the vicinity of the wall of the underground shaft. Forces from the ground or rock formation will press the steel cylinder and the concrete cylinder together so that there will not be created tangential or axial shifting movements between the steel and the concrete.

Furthermore, an inner steel cylinder may be arranged within the inner wall of the concrete cylinder. However, no frictional forces act between such an inner steel cylinder, which is usually arranged toward the center of the shaft and of the concrete cylinder, and this could lead to separation of the steel cylinder from the concrete cylinder. In this case, a bond may be usually insured by anchoring means which are welded to the outer surface of the steel cylinder and which engage the concrete cylinder.

The disadvantages of such shaft linings reside in the fact that the steel cylinder may be subjected to bending stresses as a result of the effects of working or excavating of the ground formation. Transmission of loads as a result of these forces from the steel cylinder to the concrete cylinder may frequently lead to cracks in the concrete cylinder as a result of tensile stress. Thus, the strength of the concrete cylinder will be significantly reduced and it will no longer be able to withstand the influences of ground or rock pressure and water pressure.

To avoid many of the disadvantages which arise, shaft linings have been developed which are constructed from an outer steel cylinder and an inner concrete cylinder, the outer steel cylinder being welded so as to be water-tight with the inner concrete cylinder being composed of individual rings or annular sections which are independent from each other. As a rule, the smooth steel cylinder is additionally provided with a bituminous coating on its inner surface in order to reduce the friction and thereby to allow relative movement between the concrete and the steel such as may occur during bending of the steel cylinder. However, such a measure significantly increases the amount of material used and it can be quite time consuming. On the other hand, it becomes necessary to utilize such measures in order to insure that no tensile stresses occur in the concrete cylinder since such stresses could lead to the formation of cracks or damage to the cylinder.

It has been found that in deep shafts which may run to a depth of up to 1,000 meters or more, this manner of construction is no longer useful because of the fact that there is encountered high water and rock pressure and resulting increase in the frictional forces developed. Since the steel cylinder which is rather thin does not contribute to the absorption of horizontal pressure, such pressure must be almost totally absorbed by the concrete rings. This may lead to a disproportionately large wall thickness of the concrete cylinder.

Accordingly, it is an object of the present invention to provide a shaft lining which will avoid many of the disadvantages of the known embodiments and which is suited for reduction of the relative movement between the steel cylinder and the concrete cylinder to as great a degree as possible. The invention seeks to attain these ends by a favorable design of the two cylinders and by insuring that the steel cylinder and the concrete cylinder are capable of withstanding loads from the rock or ground formation with the steel cylinder forming a water-tight seal against the wall of the underground shaft.

SUMMARY OF THE INVENTION

Briefly, the present invention comprises a structure for a flexible, leak proof composite shaft lining which is composed of a concrete cylinder formed of individual concrete rings or annular sections which are separated by joints. At least one steel cylinder is connected to the concrete cylinder and the invention is particularly characterized in that a resilient layer of flexible material is arranged to form a joint between the concrete rings of the concrete cylinder. The joint material may be plastic or some other flexible substance. The sections of the steel cylinder are connected together by spring rings which are welded to the inner surface of the steel sections in a water-tight manner and which engage the edges of the concrete ring at the level of the flexible joints formed in the concrete cylinder.

As a result, a flexible shaft lining is produced which is water-tight. In the shaft lining according to the invention, it will be found unnecessary to apply a bituminous coating between the steel cylinder and the concrete cylinder.

Another advantageous development of the invention resides in that the outer or inner steel sections or the outer and inner steel sections, preferably the inner steel sections, are connected to each other by means of spring rings which are welded to the outer surface in a water-tight manner.

In accordance with the invention it is advantageous to increase the width or thickness of the concrete joints and of the soft intermediate layers therebetween in accordance with the increase of the weight of the shaft lining with increasing depth in a construction where the shaft lining assembly is arranged to extend vertically within an underground formation.

An advantageous design of the concrete cylinder involves constructing the concrete joint in the form of a stepped configuration. This will increase the shear strength of the concrete rings.

Commercially available sections may be advantageously utilized for the spring rings.

In the lining of underground shafts, it may be found useful to omit the spring rings at the inner steel cylinder.

The composite shaft lining is also particularly suitable for shafts in which the space between the shaft wall and the shaft lining is filled with asphalt or other resilient substance which may occur because of the working or removal of ground near the shaft.

When the shaft lining of the invention is utilized, it is not necessary to use expensive filling material for this intermediate space.

In such a case, in accordance with another feature of the invention, it may prove advantageous to seal the joint between the steel sections by means of a rubber ring or a ring of similar elastic material.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF PREFERRED EMBODIMENTS

Figure 1:
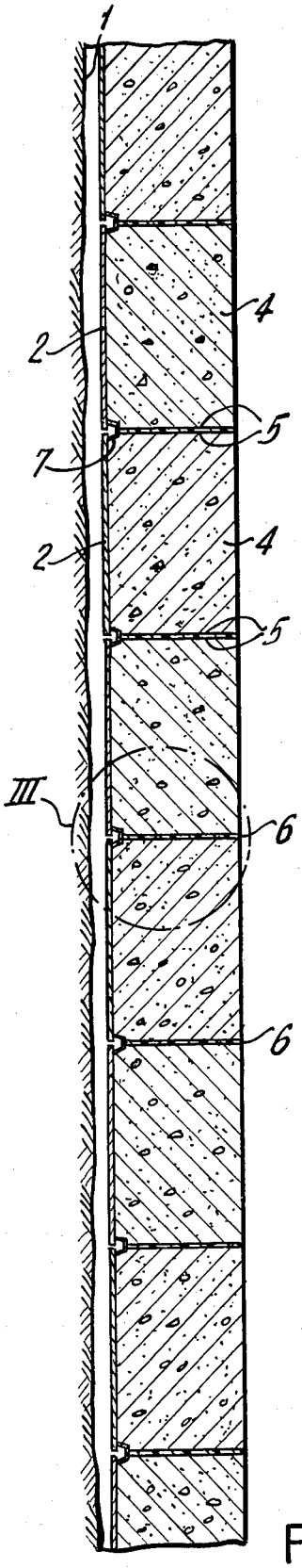
FIG. 1 is a vertical sectional view of a composite shaft lining assembly in accordance with the present invention shown within a vertical shaft and including an outer steel cylinder.
Figure 2:
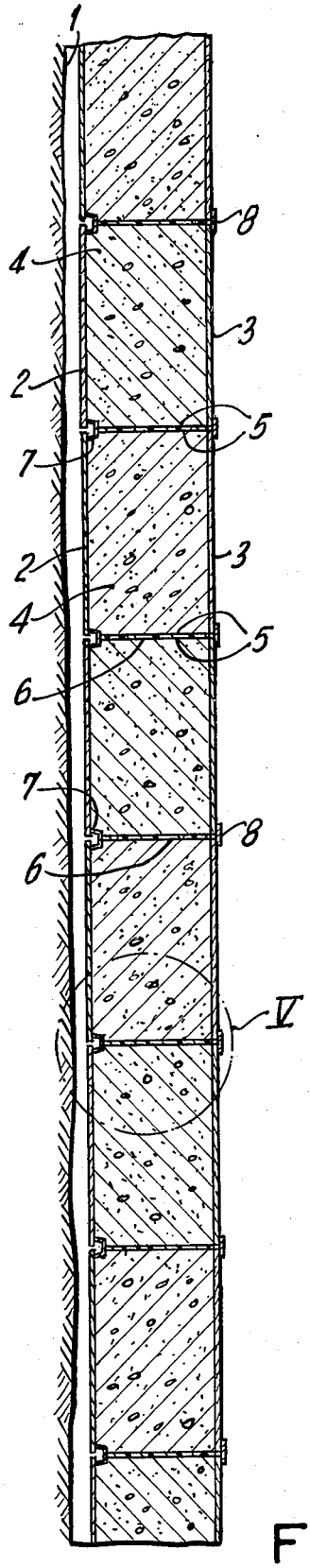
FIG. 2 is a vertical sectional view of an embodiment of the invention including outer and inner steel cylinders.

Referring now to the drawings wherein like reference numerals are used to identify similar parts throughout the various figures thereof, there is shown in FIGS. 1 and 2 a composite shaft lining assembly in accordance with the present invention. The assembly of FIG. 1 is shown only with an outer steel cylinder while the assembly accordingly to FIG. 2 is an example of an embodiment having an outer and an inner steel cylinder.

Referring first to FIG. 1, the composite lining of the present invention is inserted into an in-ground shaft having a shaft wall 1. The composite lining of the invention is formed of a plurality of annular steel sections 2 which are joined together in the longitudinal direction of the shaft wall 1 in order to form a composite outer steel cylinder. The composite lining of the invention also comprises a plurality of annular concrete sections or cylinders 4 which are joined together at their ends by joints 5 which may be plastic material or some other flexible or resilient substance. Each of the sections 2 of the outer steel cylinder are connected by spring rings 7 which extend between adjacent sections 2 of the composite steel cylinder. It will be noted that each of the springs rings 7 is arranged at the level of the joints 5 of the composite concrete inner cylinder.

Referring to FIG. 2, it will be noted that the assembly depicted therein is formed with an inner steel cylinder composed of a plurality of inner steel sections 3 which are likewise joined together by spring rings 8. Thus, it will be noted that in FIG. 2 there is shown a concrete cylinder formed of the annular concrete sections 4 with each annular concrete section 4 being joined to an adjacent concrete section by the joints 5 and with an outer steel cylinder extending about the outer cylindrical surface of the composite concrete cylinder, the outer steel cylinder being formed of the individual steel sections 2 joined together by the spring rings 7.

Figure 3:
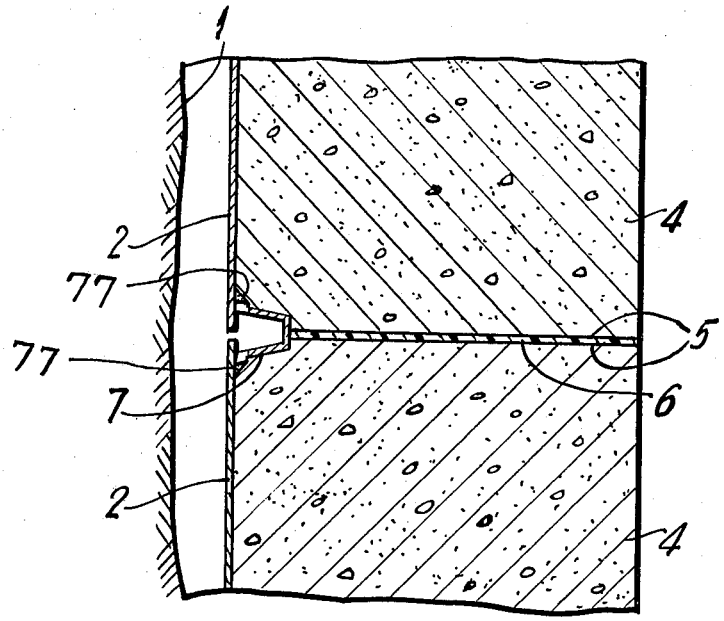
FIG. 3 is an enlarged sectional view of the portion III of FIG. 1 showing with greater clarity one of the spring rings on the outer steel cylinder.

FIG. 3 shows in greater detail a portion of the assembly of FIG. 1. As shown in FIG. 3, the individual concrete rings 4 of the composite concrete cylinder are placed one above the other spaced apart by a distance occupied by the joints 5.

By placing a soft intermediate layer 6 of plastic material or of some other flexible substance in the joints 5, the concrete cylinder consisting of the individual concrete rings 4 becomes flexible in a manner similar to that which occurs with a vertebral column and its intervertebral discs.

The flexible connection between the sections 2 of the steel cylinder is effected by the spring rings 7 which are welded on as indicated at 77 in a water-tight manner and which engage the edges of the concrete rings 4 at the level of the concrete joint 5.

Figure 4:
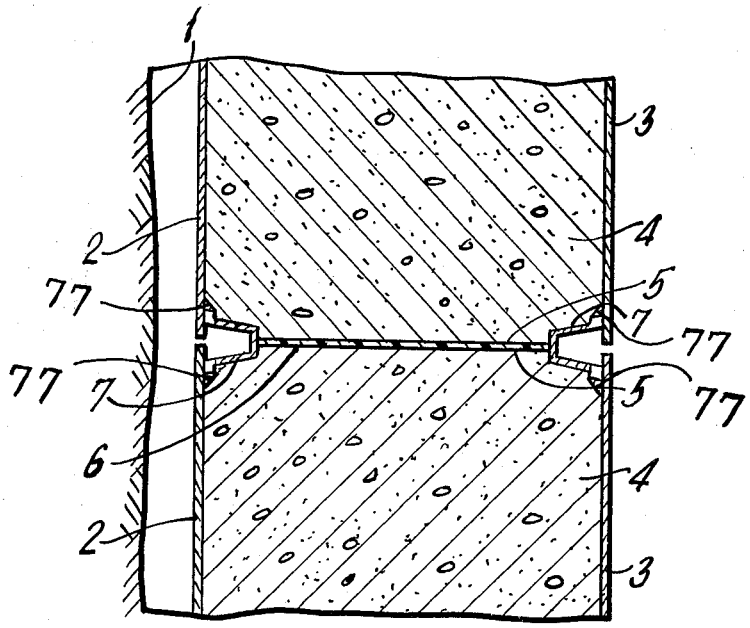
FIG. 4 is a detailed sectional view of an arrangement having similar spring rings on the inner and outer steel cylinders.

FIG. 4 shows a composite shaft lining with outer and inner steel cylinders wherein the individual sections 2 and 3 of the steel cylinders are connected to each other by means of spring rings 7. As will be noted in FIG. 4, the spring rings 7 are of a generally similar configuration.

Figure 5:
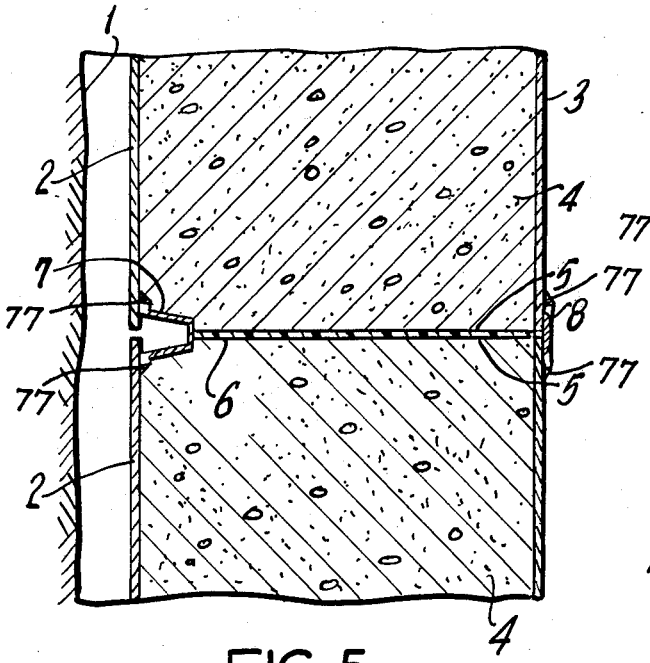
FIG. 5 is a detailed sectional view of a portion V of FIG. 2.

FIG. 5 depicts an embodiment of the invention wherein the gaps between the sections 2 which form the composite outer steel cylinder are sealed by means of spring rings 7 which are welded on at the inside, with the gaps between the sections 3 of the composite inner steel cylinder being sealed by means of springs rings 8 which are welded on at the outside.

Figure 6:
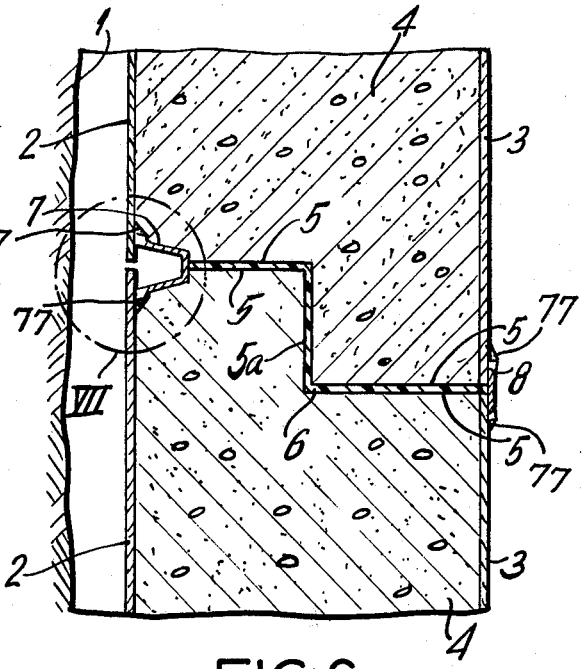
FIG. 6 is a detailed sectional view showing an arrangement wherein the concrete cylinders are formed with a stepped configuration between the joints of the concrete sections.

FIG. 6 shows a particularly advantageous embodiment of the present invention wherein the concrete joints 5 are formed in a step-like configuration including a step 5*a*. This is achieved by forming the ends of the cylinder sections 4 with stepped configurations which fit together and as a result there may be provided an increased shear strength for the concrete rings 4.

Figure 7:
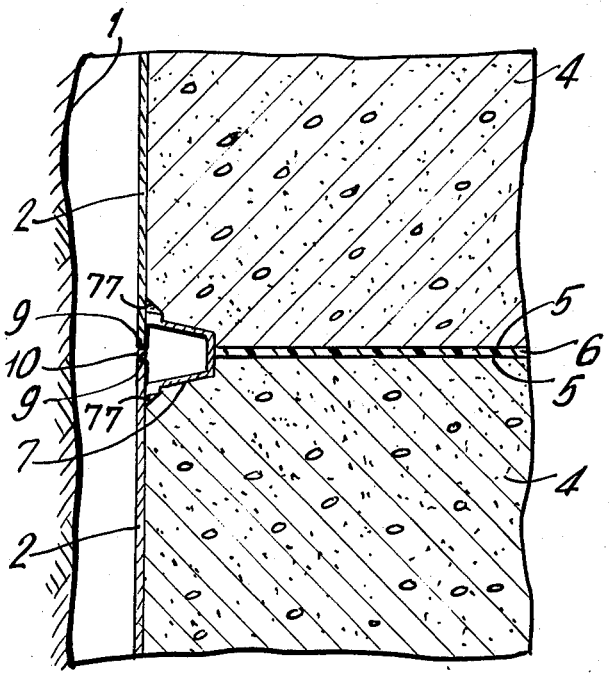
FIG. 7 is a detailed sectional view of the portion VII shown in FIG. 6.

FIG. 7 shows an embodiment of the invention for shafts where the ground is worked or removed near the shaft and wherein a joint 9 located between the sections 2 of the composite outer steel cylinder is additionally sealed by means of rings 10 which may be formed of rubber or of a similar elastic material.

The flexible and water-tight composite shaft lining will flexibly absorb forces from the ground or rock formations in which it is placed and it will prevent water from penetrating through the sealing structure which is provided as a result of the present invention.

While specific embodiments of the invention have been shown and described in detail to illustrate the application of the inventive principles, it will be understood that the invention may be embodied otherwise without departing from such principles.

What is claimed is:

1. A composite underground shaft lining assembly particularly for use as a leakproof water conduit comprising: a plurality of individual annular concrete sections arranged in a generally aligned relationship to form a composite concrete cylinder, said composite concrete cylinder having an inner cylindrical surface and an outer cylindrical surface; joint means interposed between said annular sections joining said sections together, said joint means being composed of an intermediate layer of flexible material imparting a degree of flexibility between said individual concrete sections; a composite steel cylinder arranged about said outer cylindrical surface of said composite concrete cylinder; said composite steel cylinder comprising a plurality of individual annular steel sections and spring rings connected between adjacent steel sections in a water-tight manner joining said sections together to form said composite steel cylinder; said spring rings being located adjacent each of said joint means at said outer cylindrical surface of said composite concrete cylinder.

2. An assembly according to claim 1 further comprising an inner composite steel cylinder arranged within said inner cylindrical surface of said composite concrete cylinder and formed of a plurality of individual inner annular steel sections connected to each other by means of spring rings welded between said inner steel sections in a water-tight manner on a side thereof inwardly of said shaft lining assembly.

3. An assembly according to claim 1 wherein said shaft lining assembly is arranged to extend vertically within an underground formation and wherein each of said joint means formed between said annular concrete sections comprise a soft intermediate layer having a thickness which increases in accordance with the increase of the weight of said composite shaft lining accruing between each annular concrete section with increasing depth of said shaft lining.

4. An assembly according to claim 1 wherein said joint means interposed between said individual concrete sections are formed with a stepped configuration.

5. An assembly according to claim 1 wherein said spring rings consist of commercially available rolled steel sections.

6. An assembly according to claim 1 further including an inner composite steel cylinder formed from a plurality of inner annular steel sections, said inner steel sections being arranged within said inner cylindrical surface of said composite concrete cylinder without spring rings therebetween.

7. An assembly according to claim 1 further comprising a resilient ring member extending about said joint means of said composite concrete cylinder.

8. An assembly according to claim 7 wherein said resilient ring member is formed of rubber.

9. An assembly according to claim 1 wherein said spring rings are connected across the inner surfaces of adjacent steel sections.

10. An assembly according to claim 1 wherein said spring rings comprise a generally U-shaped cross sectional configuration, with the ends of the legs of said U-shaped configuration being welded, respectively, to the inner surfaces of adjacent steel sections.

11. An assembly according to claim 10 wherein said composite concrete cylinder is formed with annular indentations on said outer cylindrical surface thereof adjacent each of said joint means, and wherein said U-shaped spring rings are fitted within said annular indentations to extend in welded connection between adjacent annular steel sections.

* * * * *